US007302766B2

(12) United States Patent
Abel

(10) Patent No.: US 7,302,766 B2
(45) Date of Patent: Dec. 4, 2007

(54) NEEDLEWORK ACCESSORY TO PROTECT NON-WORKING FABRIC ENDS OF NEEDLEWORK FABRIC MOUNTED ON A SCROLL BAR OR LIKE FRAME FROM SOIL OR DAMAGE FROM REPEATED HANDLING

(75) Inventor: June Ann Abel, Berea, OH (US)

(73) Assignee: June A. Abel, Berea, OH (US)

( * ) Notice: Subject to any disclaimer, the term of this patent is extended or adjusted under 35 U.S.C. 154(b) by 437 days.

(21) Appl. No.: 10/766,344

(22) Filed: Jan. 28, 2004

(65) Prior Publication Data

US 2004/0222247 A1 Nov. 11, 2004

(51) Int. Cl.
*D05C 1/00* (2006.01)
*D05B 97/00* (2006.01)

(52) U.S. Cl. ..... 38/102.21

(58) Field of Classification Search ..... 38/102, 38/102.1, 102.91, 102.4, 102.9; 335/296, 335/302, 303, 306; 211/86.01
See application file for complete search history.

(56) References Cited

U.S. PATENT DOCUMENTS 3,263,736 A * 8/1966 Macomson ..... 160/370.21
3,529,328 A * 9/1970 Davison ..... 24/303
3,866,649 A * 2/1975 Bringmann ..... 16/422
3,924,212 A * 12/1975 Brown ..... 335/303
4,506,616 A * 3/1985 Nixon ..... 112/475.08
4,672,747 A * 6/1987 Turner ..... 33/1 K
4,736,535 A * 4/1988 Rucker ..... 38/102.3
4,900,596 A * 2/1990 Peacock ..... 428/34.5
5,277,306 A * 1/1994 Sargent ..... 206/315.11
5,460,305 A * 10/1995 Ahearn ..... 224/562
5,657,886 A * 8/1997 Tacchella ..... 211/105.1
5,791,608 A * 8/1998 Nielsen et al. ..... 248/110
5,820,142 A * 10/1998 Duer ..... 280/33.992
6,209,240 B1 * 4/2001 Engle ..... 38/102.91

* cited by examiner

*Primary Examiner*—Ismael Izaguirre

(57) ABSTRACT

This is a needlework accessory to aid in the protection of non-working ends of needlework fabric once it is mounted on a scroll bar or like frame from becoming soiled or damaged from repeated handling. The accessory is secured to the non-working end of the needlework fabric with magnets incorporated in the ends of accessory fabric strips which then wrap around the ends of non-working needlework fabric mounted on a scroll bar or like frame.

5 Claims, 2 Drawing Sheets

FIG. 1
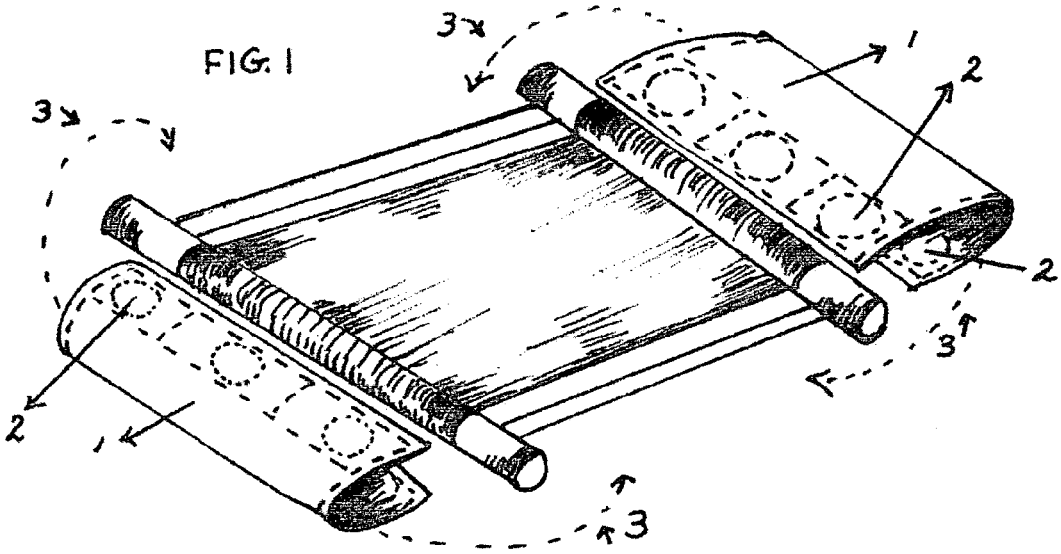
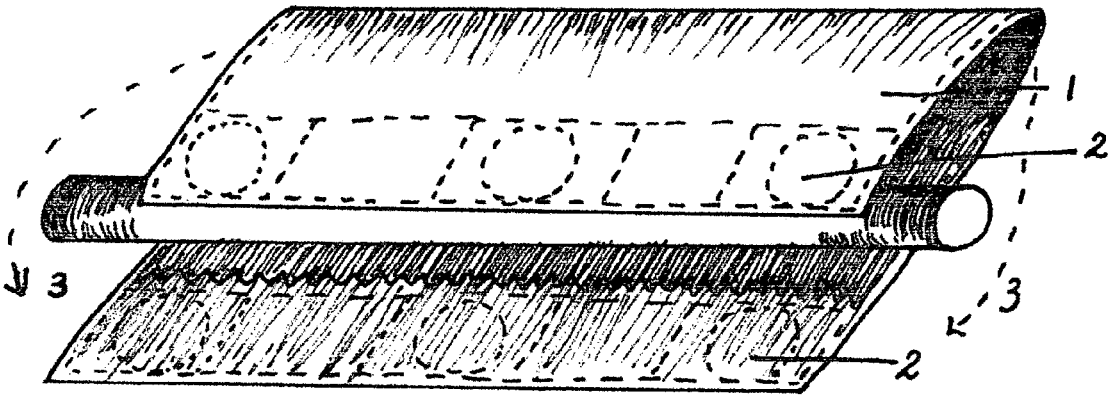
FIG. 2

NEEDLEWORK ACCESSORY TO PROTECT NON-WORKING FABRIC ENDS OF NEEDLEWORK FABRIC MOUNTED ON A SCROLL BAR OR LIKE FRAME FROM SOIL OR DAMAGE FROM REPEATED HANDLING

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

Needlework is a growing art among millions of people and continues to show new growth each year. The use of scroll bars or like frames for needlework are also increasing among people who do needlework. The need to protect the non-working ends of the needlework fabric from becoming soiled or damaged from repeated handling is present. The natural oils from your hands can soil needlework fabric and interfere with its preservability in years to come.

This present invention of a needlework accessory conveniently aids in protecting the non-working ends of needlework fabric from being soiled or damaged from repeated handling while remaining on a scroll bar or like frame until the needlework has been completed by the needleworker. The use of scroll bars or like frames by needleworkers provides an easy means to keep needlework fabric taught. Previous methods to protect non-working ends of needlework fabric on scroll bars or like frames have proven to be un-reliable. They do not stay in place, are inconvenient to use and haven't provided the protection needleworkers desire. Thus, this present invention for the needleworker is simple in design, light-weight and portable which increases the pleasure and safety of the needlework.

BRIEF SUMMARY OF THE INVENTION

This present invention is a needlework accessory to aid in the protection of non-working ends of needlework fabric mounted on scroll bars or like frames from becoming soiled or damaged from repeated handling by the needleworker.

To achieve the above, this present invention incorporates the use of magnets sewn into the top and bottom edges of slightly padded strips of fabric. The magnetic strips of fabric are wrapped around the non-working ends of the needlework fabric that has been mounted on scroll bars or like frame. It serves to protect the non-working ends of needlework fabric mounted on scroll bars or like frames which would otherwise remain exposed. The present invention allows the needleworker freedom to hold or touch the non-working ends without damaging or soiling the needlework fabric while the needleworker is working on their needlework. The present invention can remain over the needlework fabric while mounted on the scroll bars or like frames for an indefinite period of time without harm to either the needlework fabric or the scroll bars or like frames.

BRIEF DESCRIPTION OF THE SEVERAL VIEWS OF THE DRAWINGS

FIG. 1 is a perspective view of where and how the present invention of a needlework accessory fits around the top and bottom of a non-working ends of needlework fabric that has been mounted on a scroll bar or like frame.

FIG. 2 is a detailed perspective view of the one end of the present invention partially folded over on an elongated bar representing one end of a scroll bar or like frame.

DETAILED DESCRIPTION OF THE INVENTION

Figure 3:
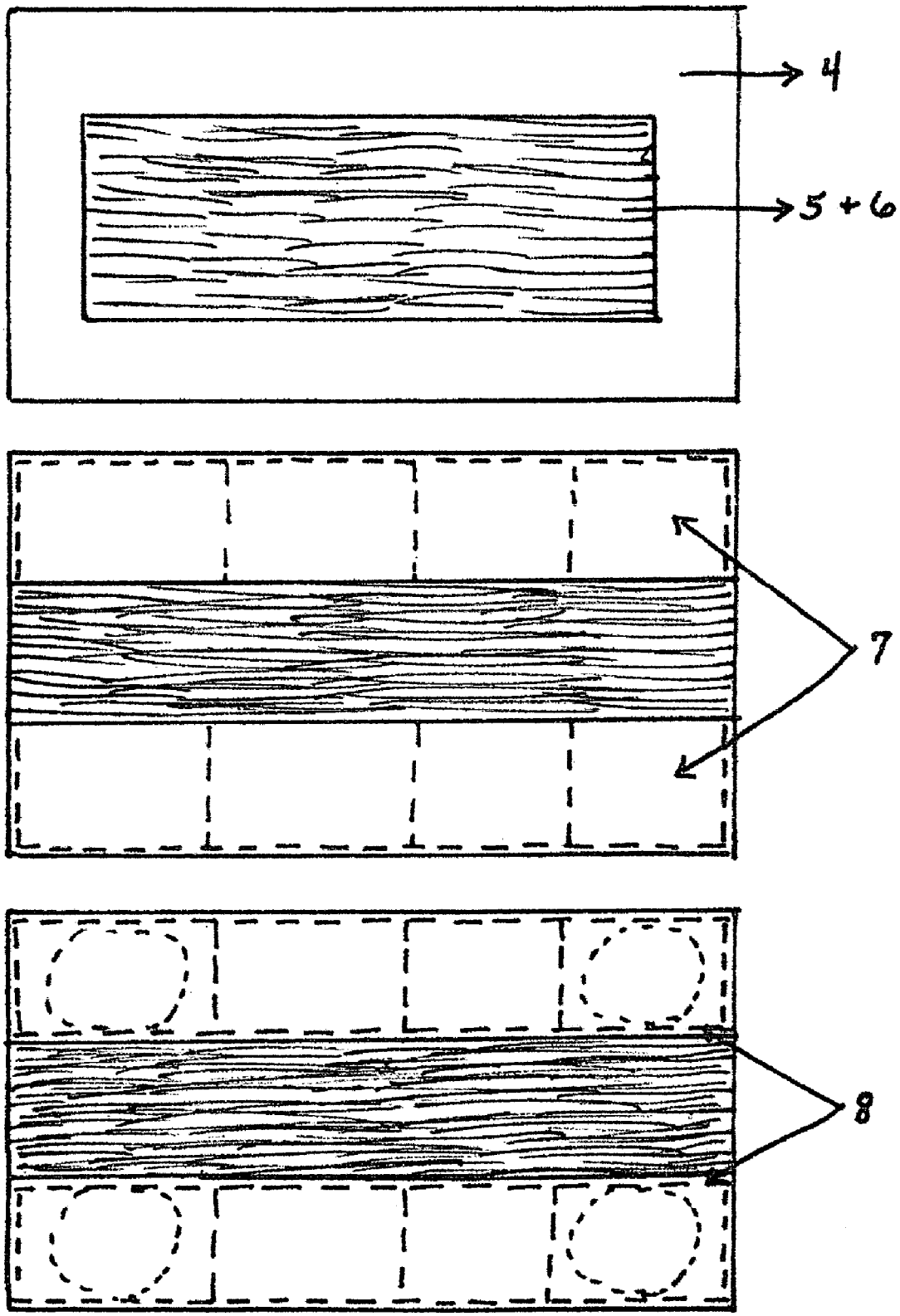
FIG. 3 is a one dimensional view of the layers used in making the present invention.

Referring to FIG. 1, the present invention is designed generally for the use by a needle-worker to place on each end of a non-working a scroll bar or like frame after needlework fabric has been mounted to protect the exposed ends from damage from repeated handling.

Referring to FIG. 2, the present invention wraps around the end of a scroll bar or bar like frame and is held together securely by the meeting of female and male magnets which are incorporated inside the ends of the present invention. The magnets provide a snug meeting of the fabric ends of the present invention. They are easy to remove or reposition by separating the fabric ends of the present invention with your hands. This produces no harm to needlework fabric mounted on a scroll bar or like frame or to the frame itself regardless of how long the present invention remains over the non-working ends of the needlework fabric.

Referring to FIG. 3, the present invention is comprised of three layers; a cotton fabric for the outer layer, a lightly padded middle layer, and a muslin or other cotton fabric on the inside. The lightly padded middle layer is used to cushion the magnets once they are placed in position to be sewn in. This further protects the outer fabric from inadvertent damage from the magnets. The three layers are sewn together around the outer edges with pockets made for the magnets to slip into which are then also sewn closed.

The invention claimed is:

1. What I claim as my invention is a new needlework accessory for sewers to protect the non-working area of stitching fabric and the secured, scrolled ends of the fabric from becoming soiled or damaged from repeated handling by means of male and female magnets incorporated inside the needlework accessory fabric lengths that adhere to each other over the ends of the needlework fabric of a size and thickness to permit the needlework accessory to wrap around scroll bars and extending a varying amount of non-working needlework surface by suitable location of the ends of the needlework accessory to prevent harm to the covered fabric from handling, dirt, or wear regardless how long the needlework accessory remains adhered to needlework fabric and the scrolled ends.

2. The needlework accessory as defined in claim 1, wherein the magnets used are round magnets, magnetic strips, donut magnets, square magnets, triangle magnets.

3. The needlework accessory of claim 1 or claim 2, wherein providing at least one metallic (containing iron) member including washers, discs, slugs, or strips as one of the opposing magnets produces the same results of securing the fabric ends together of the needlework accessory.

4. The needlework accessory as defined in claim 1, wherein fabrics used include cotton, non-cotton, vinyl, suede, leather, plastics and polyester materials to produce the needlework accessory.

5. The needlework accessory as defined in claim 1 will vary in size (length, width and diameter) in relation to the size, type of magnets used and various sizes of scroll bars used.

* * * * *